US008016956B2

(12) United States Patent
Zhang et al.

(10) Patent No.: US 8,016,956 B2
(45) Date of Patent: Sep. 13, 2011

(54) CE-BASED AMORPHOUS METALLIC PLASTIC

(75) Inventors: Bo Zhang, Beijing (CN); Deqian Zhao, Beijing (CN); Mingxiang Pan, Beijing (CN); Weihua Wang, Beijing (CN)

(73) Assignee: Institute of Physics, Chinese Academy of Sciences, Beijing (CN)

( * ) Notice: Subject to any disclaimer, the term of this patent is extended or adjusted under 35 U.S.C. 154(b) by 249 days.

(21) Appl. No.: 11/912,146

(22) PCT Filed: Apr. 7, 2006

(86) PCT No.: PCT/CN2006/000617

§ 371 (c)(1), (2), (4) Date: Oct. 20, 2007

(87) PCT Pub. No.: WO2006/111068

PCT Pub. Date: Oct. 26, 2006

(65) Prior Publication Data

US 2008/0105338 A1 May 8, 2008

(30) Foreign Application Priority Data

Apr. 21, 2005 (CN) ..... 2005 1 0066113

(51) Int. Cl.
*C22C 45/00* (2006.01)

(52) U.S. Cl. ..... 148/403

(58) Field of Classification Search ..... 148/403
See application file for complete search history.

(56) References Cited

U.S. PATENT DOCUMENTS 5,362,339 A * 11/1994 Horimura et al. ..... 148/403
6,214,480 B1 * 4/2001 Hosoe et al. ..... 428/615

* cited by examiner

*Primary Examiner* — Sikyin Ip
*Assistant Examiner* — Yoshitoshi Takeuchi
(74) *Attorney, Agent, or Firm* — Chainey P. Singleton; Edwin S. Flores; Chalker Flores, LLP

(57) ABSTRACT

The present invention concerns a Ce-base amorphous metallic plastics being $Ce_aAl_bM_c$, in which 55≦a≦75, 5≦b≦25, 10≦c≦25, and a+b+c=100; said M is Co, Cu or Ni. Otherwise the metallic plastics could be $Ce_dAl_eCu_fZ_g$, in which 55≦d≦75, 5≦e≦15, 15≦f≦25, 0.01≦g≦10, and d+e+f+g=100; said Z is one element selected from Co, Fe, Hf, Mg, Mo, Nb, Sc, Ta, Ti, W, Zn and Zr. The metallic plastic could also be $Ce_hAl_iCu_jNi_k$, in which 55≦h≦75, 5≦i≦15, 15≦j≦25, 0.01≦k<5, and h+i+j+k=100. The Ce-base amorphous metallic plastic has a low glass-transition temperature and a wide super-cooling liquid phase area, therefore possesses a high thermal stability. The material could be deformed, shaped and imprinting worked into desired amorphous alloy articles as thermoplastic plastics at a very low temperature.

3 Claims, 4 Drawing Sheets

CE-BASED AMORPHOUS METALLIC PLASTIC

FIELD OF INVENTION

The present invention belongs to the field of amorphous metal alloys and especially concerns a Ce based amorphous metallic plastic.

BACKGROUNDS

Compared with metallic glasses, polymeric glasses have superior glass forming ability, low glass transition temperature ($T_g$) and wider supercooled liquid region ($\Delta T$, defined as the difference between $T_g$ and the onset crystallization temperature $T_x$), thus have a very wide range of applicability. The thermoplasticity nature of common glassy polymers is exploited in molding and imprinting. Since chemical scientists invented the thermoplastics in 1940's, they became the basic materials for the $2^{nd}$ industrial revolution. Although their strength is only about one fiftieth of that of steels, thermoplastics products became very cheap because they could be prepared repeatedly using the same mold at a temperature near room temperature. Now thermoplastics are widely used in our daily lives.

In the early 1960's, non-crystalline alloys (so called metallic glasses) were firstly fabricated in laboratories. Compared with polymers, metallic glasses also have advantages in mechanical, electrical, magnetic and chemical properties. Amorphous metal alloys have a supercooled liquid region $\Delta T$ above $T_g$. When an amorphous metal alloy was heated into this region, it still keeps its glassy state and does not crystallized immediately. In general, the wider range of $\Delta T$ suggests better deformability of the supercooled state. Therefore, the stability against crystallization is crucial for deformation of an amorphous metal alloy in its supercoolied state. The stability during a heating process is closely related with the critical cooling rate necessary for forming a glass from its liquid. For a good glass former, it is expected that the time-temperature-transformation (TTT) curve will move toward the long time direction.

The conventional melt-spin glasses have a limited $\Delta T$ and could not be used to investigate the related properties of the supercooled liquid region. In the early 1990's, bulk metallic glasses (BMGs) with large size up to millimeters even centimeter scales in three dimensions were developed using conventional casting methods. For most of BMGs, their values of $\Delta T$ are larger than 45 K and even larger than 100 K in some case. The supercooled liquids of these BMGs show typical Newtonian flow characteristics at low strain rates or low stresses and the maximum elongation could reach about 15000%. For crystalline alloys, they are unable to deform as easily as the viscous supercooled liquids of BMGs, which are capable of remaining the glassy structure and original properties even after large plastic deformation. The unique combination of these superior properties and homogeneous microstructure makes BMGs a new type of engineering materials in applications such as manufacturing the micro-electro-mechanical components. Meanwhile, high strain rates and superplasticity are suitable for quality control, thus make it possible for the mass production.

For most of the known BMGs, however, their industrial applications are still impeded by the limitation of alloy size and the lack of workability and machinability. The polymer-like exploitation of the supercooled viscous flow of many BMGs was also postponed due to low $T_g$ and low stability against crystallization. Additionally, some BMGs based on noble metals like Pd, Pt and Au can only be used in the experimental laboratory because of their high cost although they have good glass forming ability and superplasticity in the supercooled liquid region.

DETAILED DESCRIPTION OF THE INVENTION

The present invention is aimed to overcome the problems in the known BMGs and thus to provide a new type of BMGs named Ce-based amorphous metallic plastics. These problems are the limitation of the small size, poor workability and machinability, the limitation in exploitation of the viscous supercooled liquid due to high $T_g$ and low crystallization resistance and the high cost in some BMGs containing the noble metals such as Pd, Pt and Au. The present amorphous metallic plastics have extremely low $T_g$, wide supercooled liquid region $\Delta T$ and low cost coming from the cheap raw materials having low purity.

The invention is realized using the following techniques and methods.

The invention provides amorphous metallic plastics based on Cerium which can be represented by the following formula:

$$Ce_aAl_bM_c$$

in which $55 \leqq a \leqq 75$, $5 \leqq b \leqq 25$, $10 \leqq c \leqq 25$, and $a+b+c=100$.

The M can be one of three elements Co, Cu and Ni.

The purities of the said Ce, Al and M are no less than 99.5.wt. % (weight percent).

The present invention provides Ce-based amorphous metallic plastics which can be represented by the following formula:

$$Ce_dAl_eCu_fZ_g$$

in which $55 \leqq d \leqq 75$, $5 \leqq e \leqq 15$, $15 \leqq f \leqq 25$, $0.01 \leqq g \leqq 10$, and $d+e+f+g=100$.

Z is one element selected from Co, Fe, Hf, Mg, Mo, Nb, Sc, Ta, Ti, W, Zn and Zr.

The purities of the said Ce, Al, Cu and Z are no less than 99.5.wt. % (weight percent).

Furthermore, the present invention provides Ce-based amorphous metallic plastics which can be represented by the following formula:

$$Ce_hAl_iCu_jNi_k.$$

in which $55 \leqq h \leqq 75$, $5 \leqq i \leqq 15$, $15 \leqq j \leqq 25$, $0.01 \leqq k \leqq 55$, and $h+i+j+k=100$.

The purities of the Ce, Al, Cu and Ni are no less than 99.5.wt. % (weight percent).

The above-described Ce-based amorphous metallic plastics can be prepared using the conventional method known in the field of metallic glasses. Specifically, the preparation method includes the following steps:

1) Preparation of mother ingots: In a Ti-absorbed arc melting furnace under Argon atmosphere, a mixture of elements Ce, Al and M according to the above formula $Ce_aAl_bM_c$, or a mixture of Ce, Al, Cu and Z according to the above formula $Ce_dAl_eCu_fZ_g$, or a mixture of Ce, Al, Cu and Ni according to the above formula $Ce_hAl_iCu_jNi_k$ is blended and melted until homogeneity, and then cooled to form a mother ingot.

2) Suction casting: In a Ti-absorbed arc melting furnace under Argon atmosphere, the mother ingot prepared in the first step is remelted and then suction casted into a copper mold with different cavities to form a sample in the form of rod or sheet.

It should be stressed that many modifications and changes can be made to the present invention without departing the spirit and scope thereof. Although what the instant invention illustrates is to produce Ce-based amorphous metallic plastics by forming an amorphous ingot in a way of suction casting, it is well-known to the person ordinarily skilled in the art that any suitable technique for fabricating non-crystalline alloys or any related casting method under a protective atmosphere such as spray casting, single- or twin-roll melt-spinning, planar flow casting and metal pulverization and so on can also be used to prepare Ce-based amorphous metallic plastics.

For the present Ce based amorphous metallic plastics, the amorphous nature and the volume fraction of the amorphous phase can be determined and evaluated using known techniques such as X-ray diffraction (XRD) and high-resolution transmission electron microscopy (HRTEM). In the examples of the present invention, XRD measurements were carried out on a MAC M03 XHF diffractometer with Cu $K_a$ radiation and HRTEM measurements on a TECNAI-F20 instrument operated at 200 kV. The thin foils for the HRTEM measurements were prepared by mechanical thinning and chemical polishing.

Similarly, any suitable methods can also be used to examine the thermal properties of the Ce-based amorphous metallic alloys. By way of an example, the thermal properties of our samples were determined by differential scanning calorimetry (DSC) under a purified argon atmosphere in a Perkin-Elmer DSC-7, calibrated for temperature and energy with high-purity indium and zinc. Both isothermal and continuous heating (at a rate of 10 K $min^{-1}$) were used The mechanical properties and density data, etc of the present Ce based alloys can be measured using many universal instruments. In the present invention, the mechanical properties including yield strength and elastic strain were measured at room temperature and at 90° C. by an MTS 880 system. Compression tests were conducted at a strain rate of $1\times10^{-3}s^{-}$. Acoustic velocities were determined by a pulse echo overlap method on a MATEC 6600 ultrasonic system with a measuring sensitivity of 0.5 ns and a frequency of 10 MHz. Young's modulus E, bulk modulus B, Poisson's ratio v and shear modulus G were derived from the acoustic velocities. The density was determined by the Archimedean technique and the accuracy lies within 0.1%. Vickers hardness was measured with a Polyvar Met microhardness tester using a load of 1.96 N. The electrical resistance of the sample at room temperature was measured on a PPMS 6000 instrument (Quantum Design Instrument, Inc.).

The Ce based amorphous metallic plastics defined in the present invention should contain the amorphous phase with a volume fraction of at least 50%. In most cases, the Ce based amorphous metallic plastics prepared according to the present invention have a single amorphous phase, a wide supercooled liquid region ΔT of no less than 20 K and a low $T_g$ of no more than 430 K. These thermal parameters (ΔT and $T_g$) can be examined using DSC method at a scanning rate of 10 K/min.

The Ce based amorphous metallic alloys in this invention have an extremely low $T_g$ close to room temperature, a wide supercooled liquid region and high stability against crystallization, thus can be deformed homogeneously in their viscous supercooled liquid state in low temperatures like the near boiling point of water. This polymerlike superplasticity (homogenous deformation) of these Ce based amorphous metallic alloys makes them very easy to form or imprint a complex product with an amorphous structure. For example, in this invention, a precise shape or article can be imprinted on the surface of a Ce based amorphous metallic sample in near boiling water under a pressure of 30~300 MPa.

Generally, compared with the prior arts, the present Ce based amorphous metallic plastics contain Ce as a main component and also several addition elements like Al, Co, Cu, Fe, and Nb, and have advantages as follows:

1. They have high glass forming ability, and easily cast into bulk glasses with different sizes ranging from millimeter to centimeter;
2. They have extremely low $T_g$ and can deform like polymeric thermoplastics;
3. They have wide supercooled liquid regions and high thermal stability against crystallization, thus are suitable for industrial production (i.e. a long manufacturing time before crystallization);
4. They have high thermostability at low temperatures near the boiling point of water in their supercooled liquid states, thus are able to deform repeatedly in a precise die.
5. They contain the addition components selected from commonly used metals like Al, Co, Cu, Fe, Zn, Nb and so on, which can obviously decrease the cost of materials.

Figure 4:
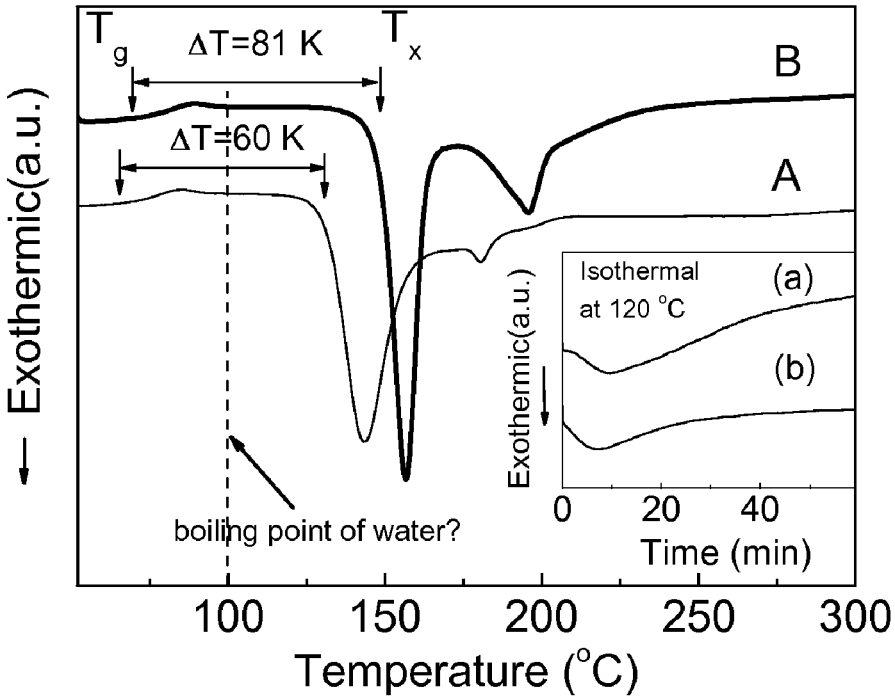
FIG. 4 shows DSC results at a heating rate of 10 K/min for the $Ce_{70}Al_{10}Cu_{20}$ glassy sample (A) prepared in Example 1 and the $Ce_{68}Al_{10}Cu_{20}Nb_2$ glassy sample (B) prepared in Example 3.

The inset picture in the right corner in FIG. 4 shows isothermal DSC traces for $Ce_{70}Al_{10}Cu_{20}$ glass (prepared in Example 1) held at 120° C.: (a) immediately after casting, and (b) after three months at room temperature (20-38° C.).

Figure 5:
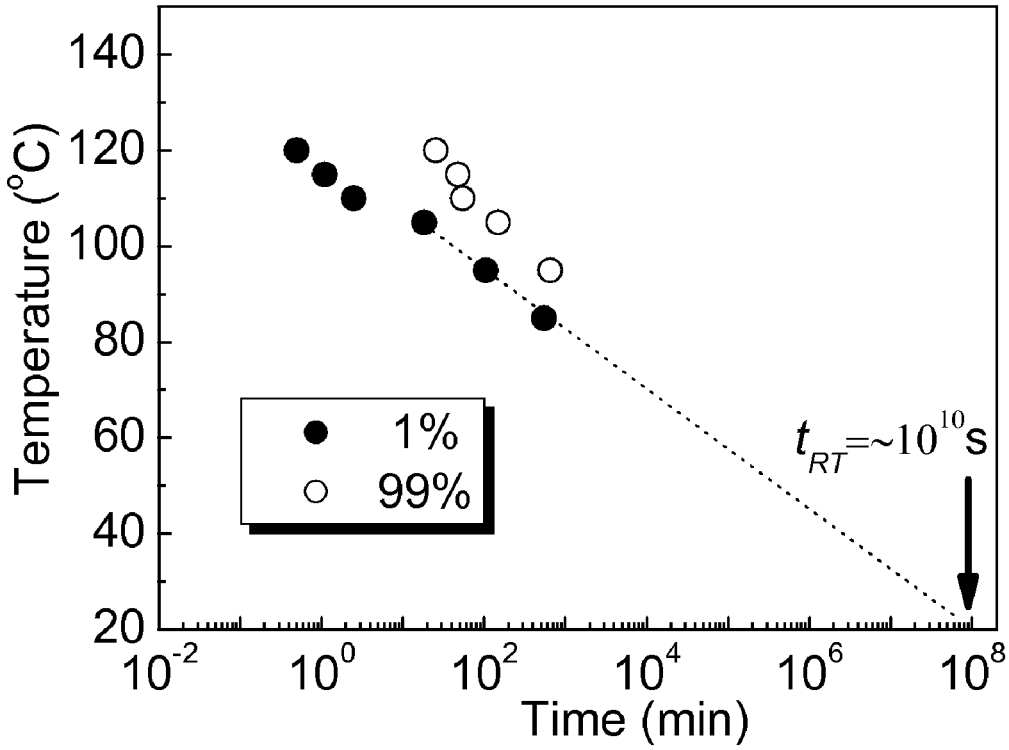

FIG. 5 shows the time-temperature-transformation (TTT) diagram for crystallization of $Ce_{70}Al_{10}Cu_{20}$ glass in Example 1. Isothermal DSC traces have been used to estimate the times to 1% (open circle) and 99% (solid circle) crystallized at each temperature. The dashed line extrapolated to room temperature (~20° C.) shows the onset time for crystallization at that temperature to be ~$10^{10}$ s (~200 years).

Figure 6:
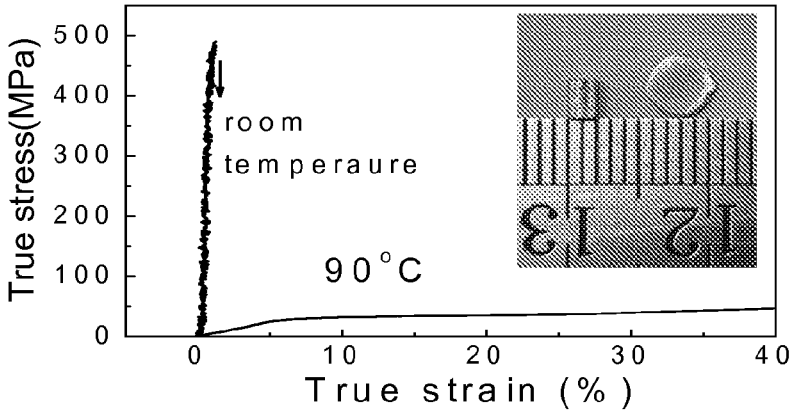

FIG. 6 shows the true stress-true strain curve of a 2 mm diameter $Ce_{70}Al_{10}Cu_{20}$ glassy rod (in Example 1) tested under compression at RT and at 90° C.

The inset of FIG. 6 shows the starting sample, 2 mm in diameter and 3 mm in height, on the left and the sample compressed at 90° C., 5 mm in diameter and 0.3 mm in height, on the right.

Figure 7:
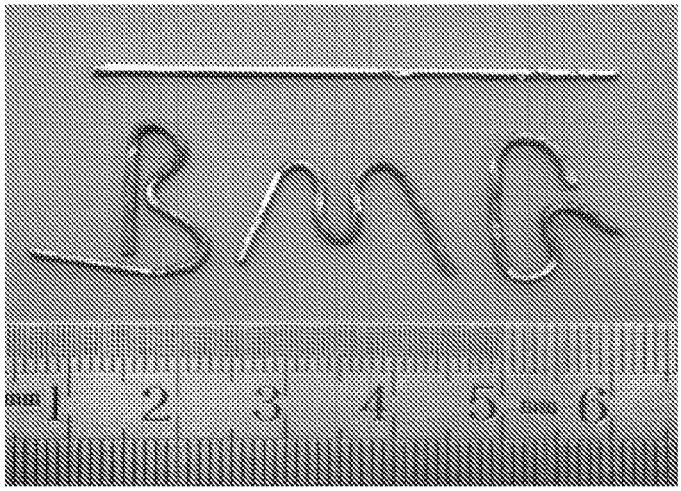

FIG. 7 shows the 1 mm diameter glassy rods (prepared in Example 1) formed into letters by simple manipulation in near-boiling water.

Figure 8:
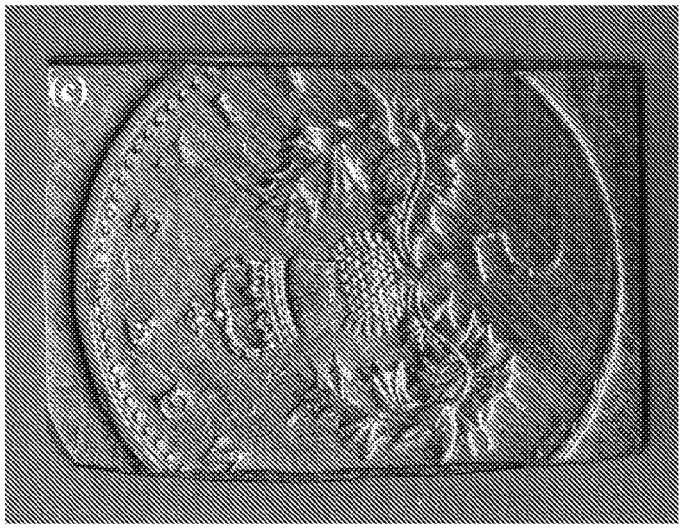

FIG. 8 shows the impression of a UK five-pence coin made on the surface of a $Ce_{70}Al_{10}Cu_{20}$ glassy sheet (prepared in Example 1) held in near-boiling water, demonstrating excellent imprintability and viscous deformability.

Figure 9:
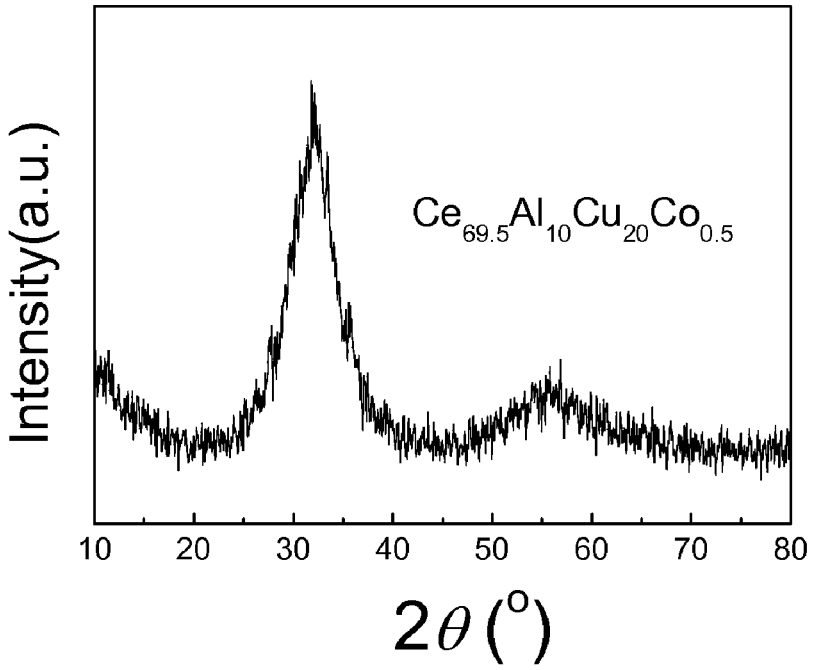

FIG. 9 shows XRD results of the 10 mm diameter as-cast $Ce_{69.5}Al_{10}Cu_{20}Co_{0.5}$ glassy rod prepared in Example 2.

Figure 10:
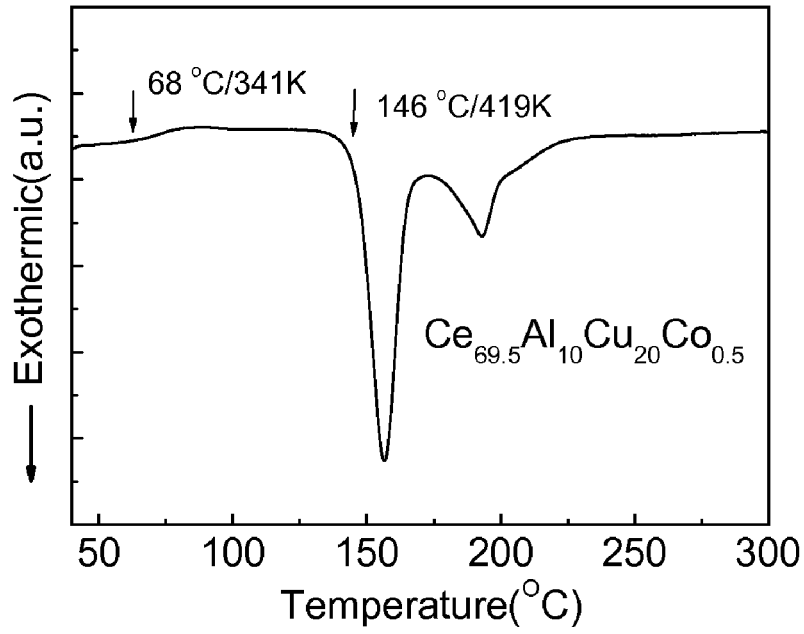

FIG. 10 shows DSC results at a scanning rate of 10 K/min for the 10 mm diameter as-cast $Ce_{69.5}Al_{10}Cu_{20}Co_{0.5}$ glassy rod prepared in Example 2.

MODE OF CARRYING OUT THE INVENTION

EXAMPLE 1

$Ce_{70}Al_{10}Cu_{20}$ Amorphous Metallic Plastic

Ingots with nominal compositions of $Ce_{70}Al_{10}Cu_{20}$ (at. %) were prepared by arc melting commercial-purity Ce (99.5 wt. %) with high-purity Al (99.99%), Cu (99.99%) and Nb (99.9%) under a purified argon atmosphere. The ingots were remelted and suction-cast into a Cu-mould with different cavities (cylinder or sheet) to obtain bulk form such as a sheet with dimension of 1.5×12×70 $mm^3$ (see FIG. 1A) and the rods with 1 mm (see FIG. 7) and 2 mm (see the inset in FIG. 6) in diameter.

Figure 1:
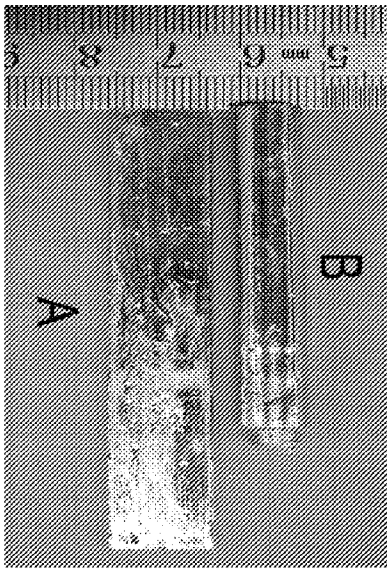
FIG. 1 shows the appearance of Ce-based amorphous metallic plastics of the present invention. A $Ce_{70}Al_{10}Cu_{20}$ glassy sheet with a size of 1.5×12×70 $mm^3$ (A) is the sample prepared in Example 1. An as-cast $Ce_{68}Al_{10}Cu_{20}Nb_2$ glassy rod of 8 mm in diameter (B) is prepared in Example 3.

The as-cast 2 mm diameter $Ce_{70}Al_{10}Cu_{20}$ rod is fully glassy. As shown in FIG. 1, the samples can be cast in rod and in sheet form with lustrous surfaces. As expected for casting of glassy alloys, when solidification does not involve crystallization, there is very little volume shrinkage, with consequent good castability. Earlier work on BMGs based on rare earth metals, for example on neodymium, has shown that it can be difficult to obtain fully glassy structures; often there is a significant proportion of nanocrystals in the glassy matrix. For this reason particular care was taken to establish the structures of the cast alloys in the present work.

Figure 2:
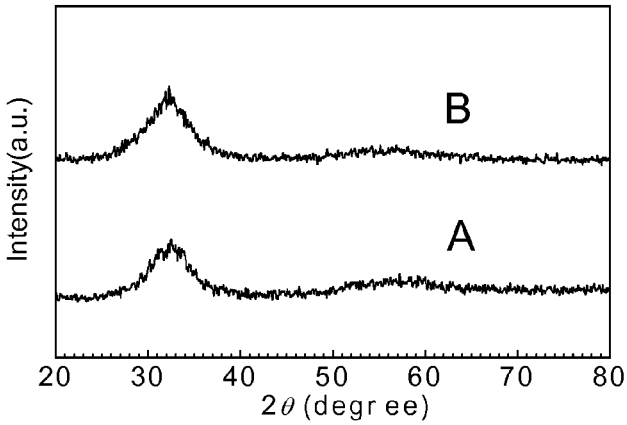
FIG. 2 shows XRD results of a $Ce_{70}Al_{10}Cu_{20}$ glassy sheet of 2 mm in diameter (A) with a size of 1.5×12×70 $mm^3$ prepared in Example 1 and an as-cast $Ce_{68}Al_{10}Cu_{20}Nb_2$ glassy rod of 8 mm in diameter (B) prepared in Example 3.

The XRD pattern of the 2 mm diameter $Ce_{70}Al_{10}Cu_{20}$ rod is shown as curve A in FIG. 2. The XRD patterns show only two broad maxima associated with an amorphous phase and no detectable Bragg peaks corresponding to crystalline phases. This shows that the alloy is fully amphous.

Figure 3:
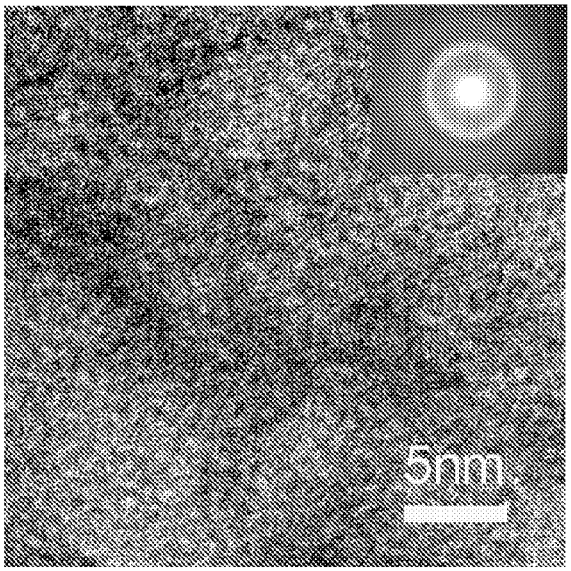
FIG. 3 shows HRTEM image and selected-area electron diffraction pattern for the 1 mm diameter $Ce_{70}Al_{10}Cu_{20}$ as-cast sample prepared in Example 1, showing a single glassy phase with no evidence for nanocrystallization.

HRTEM is more sensitive than XRD to minitor volume fractions of dispersed crystals. As seen in FIG. 3, HRTEM results for 1 mm diameter $Ce_{70}Al_{10}Cu_{20}$ rod still show only the uniform contrast expected for a single glassy phase.

The DSC trace for the as-cast $Ce_{70}Al_{10}Cu_{20}$ alloy at 10 K/min is shown in FIG. 4. The clear exothermic peak indicates its glassy nature, in contrast to the decaying exothermic signal expected for coarsening of a polycrystalline structure. The $Ce_{70}Al_{10}Cu_{20}$ sample shows a $T_g$ of 68° C. (341 K), lower than any previous BMGs, and a large supercooled liquid region ($\Delta T=T_x-T_g=69$ K). The $T_g$ of the sample is very close to those of typical polymers like Nylon (~43° C./316 K) and polyvinylchloride (75-105° C./348-378 K).

The stability of the $Ce_{70}Al_{10}Cu_{20}$ glassy alloy is examined by isothermal DSC method. As shown in the inset of FIG. 4, the isothermal DSC curves at 120° C. suggested that a sample stored at RT (20 to 38° C.) for three months is still glassy. The stability was further investigated over a range of temperature. Isothermal DSC was used to determine the time-temperature-transformation (TTT) diagram (see FIG. 5) to estimate the times to 1% and 99% crystallized at each temperature. As an empirical guide to stability, FIG. 5 gives an Arrhenius extrapolation with a predicted lifetime at 20° C. of ~$10^{10}$ s (or 200 years), which suggests that $Ce_{70}Al_{10}Cu_{20}$ glassy alloy has considerably high stability.

As seen in FIG. 6, at room temperature the $Ce_{70}Al_{10}Cu_{20}$ glassy alloy is brittle, even in compression showing ~1.5% elastic strain followed by catastrophic failure. However, raising the temperature to 90° C. (in the supercooled liquid state) gives a complete change in behavior, to perfect superplasticity. The sample can be compressed to about 10% of its original height without cracking (see the inset of FIG. 6). Just as expected for a conventional polymeric thermoplastic, the material can be repeatedly compressed, stretched, bent and formed into complicated shapes.

The temperature required for this excellent deformability is approximately 100° C., which is normal for polymers but highly unusual for metallic alloys. The ease of thermoplastic forming can be demonstrated using near-boiling water (FIG. 7). It has been verified by XRD that samples remain fully amorphous after 10 min in near-boiling water, consistent with the TTT diagram (FIG. 5).

Although showing thermoplastic behaviour like nylon or PVC, the $Ce_{70}Al_{10}Cu_{20}$ metallic thermoplastics show mechanical and physical properties, which are very different from polymeric materials. Their density (6738 kg $m^{-3}$), Vickers hardness (1.50 GPa), fracture toughness (10.0 MPa $m^{1/2}$), E=29.91 GPa, K=29.18 GPa, G=11.25 GPa, Poisson's ratio (0.32) and tensile strength (490 MPa) are all much higher than those of typical polymers. The electrical resistivity of the BMG is ~119 μΩ-cm; it is thus a metallic conductor, in contrast to the insulating properties of typical polymers.

The excellent imprintability and viscous deformability of the $Ce_{70}Al_{10}Cu_{20}$ metallic thermoplastics can also be demonstrated by the impression of a UK five-pence coin made on the surface of its sheet held in near-boiling water by hand pressure.

It may also be very useful that this imprintability is combined with electrical conductivity.

EXAMPLE 2

$Ce_{69.5}Al_{10}Cu_{20}Co_{0.5}$ Amorphous Metallic Plastic

Using the same preparation methods described in Example 1, $Ce_{69.5}Al_{10}Cu_{20}Co_{0.5}$ amorphous metallic plastic was developed. Compared with $Ce_{70}Al_{10}Cu_{20}$, $Ce_{69.5}Al_{10}Cu_{20}Co_{0.5}$ shows larger glass forming ability with a critical diameter of 10 mm. The amorphous nature of $Ce_{69.5}Al_{10}Cu_{20}Co_{0.5}$ as-cast alloy was also demonstrated by the XRD method as shown in FIG. 9. The $T_g$ value of $Ce_{69.5}Al_{10}Cu_{20}Co_{0.5}$ glass was not obviously changed and remained as the same value as that of $Ce_{70}Al_{10}Cu_{20}$, while the $\Delta T$ of $Ce_{69.5}Al_{10}Cu_{20}Co_{0.5}$ increased to ~78 K (~10 K larger than that of $Ce_{70}Al_{10}Cu_{20}$). The DSC results of the $Ce_{69.5}Al_{10}Cu_{20}Co_{0.5}$ glassy alloy were presented in FIG. 10. This alloy is most characterized in that a dramatic change in glass forming ability can be achieved by adding a very small amount of Co into $Ce_{70}Al_{10}Cu_{20}$ alloy. Its elastic constants E, G and K are 31.1 GPa, 11.6 GPa and 31.3 GPa, respectively. All these thermal and mechanical data are listed in Table I.

EXAMPLE 3

$Ce_{68}Al_{10}Cu_{20}Nb_2$ Amorphous Metallic Plastic

For this composition, a glassy rod with at least 8 mm in diameter can be prepared using the same preparation methods described in Example 1. Its appearance picture is shown in FIG. 1, DSC results in FIG. 4 and XRD results in FIG. 2. The thermal parameters and elastic constants of the $Ce_{68}Al_{10}Cu_{20}Nb_2$ alloy are also listed in Table I. Compared with $Ce_{70}Al_{10}Cu_{20}$ in Example 1, the glass forming ability of $Ce_{68}Al_{10}Cu_{20}Nb_2$ alloy is greatly improved from about 2 mm to at least 8 mm in the critical diameter. The ΔT of $Ce_{68}Al_{10}Cu_{20}Nb_2$ glassy alloy is ~76 K, which is about 7 K larger than that of $Ce_{70}Al_{10}Cu_{20}$, suggesting a higher stability of the $Ce_{68}Al_{10}Cu_{20}Nb_2$ glass forming liquid against crystallization. Elastic constants including E (31 GPa), G (11.7 GPa) and K (30 GPa) are nearly the same as those of $Ce_{70}Al_{10}Cu_{20}$ (Example 1) and $Ce_{69.5}Al_{10}Cu_{20}Co_{0.5}$ (Example 2).

EXAMPLE 4~8

Five Ce based ternary $Ce_aAl_bM_c$ amorphous metallic plastics of Examples 4 to 8 were prepared using the same method as that of Example 1, where M is one element selected from Co, Cu and Ni. The detailed composition for these five ternary alloys are listed in Table I. Their glass forming ability indicated by the critical diameter $d_c$ and thermal properties including $T_g$, $T_x$, ΔT, $T_m$ (the melting temperature) and $T_l$ (the liquidus temperature) are all listed in Table I.

EXAMPLE 9~35

All the Ce-based amorphous metallic plastics of Examples 9 to 35 can be prepared using the same method described in Example 1. Their compositions all come from the formula $Ce_dAl_eCu_fZ_g$ and $Ce_hAl_iCu_jNi_k$, where Z is one element selected from Co, Fe, Ni, Hf, Mg, Mo, Nb, Sc, Ta, Ti, W, Zn and Zr. Their XRD results are similar to those of Example 3. For the alloys of Examples 9 to 19, their compositions and thermal data detected by the DSC method are listed in Table I. For Examples 9-11, 13 and 14, their elastic constants (E, G and K) are also listed in Table I. For the alloys of Examples 20-35, the compositions and the minimum volume fraction of the glass phase in each alloy are shown in Table II. Compared with the ternary alloy $Ce_{70}Al_{10}Cu_{20}$ (Example 1), the introduction of the fourth element like Z and Ni in these quaternary alloys can improve its glass forming ability more or less, but does not change its elastic properties very much.

In general, in the present invention, most of the Ce based amorphous metallic plastics show extremely low $T_g$ in the range of 341-364 K, very close to those of typical polymeric glasses like Nylon (~316 K) and PVC (348-378 K). By introducing the additional element, the $T_g$ of Ce based amorphous metallic plastics can be adjusted to meet the requirements of manufacturing and application. Therefore, the Ce-based amphous metallic plastics provided by the present invention can be deformed so as to form desired shapes, as with thermoplastic plastics.

TABLE II

□Compositions, critical diameter($d_c$) and critical volume fraction(f ) of the glassy phase for Ce based amorphous metallic plastics

| Example No. | Composition | $d_c$ (mm) | f |
|---|---|---|---|
| 20. | $Ce_{65}Al_{10}Cu_{20}Zn_5$ | 5 | >60% |
| 21. | $Ce_{69}Al_{10}Cu_{20}Hf_1$ | 2 | >90% |
| 22. | $Ce_{68}Al_{10}Cu_{20}Hf_2$ | 2 | >80% |
| 23. | $Ce_{69}Al_{10}Cu_{20}Mg_1$ | 2 | >50% |
| 24. | $Ce_{68}Al_{10}Cu_{20}Mg_2$ | 3 | >70% |
| 25. | $Ce_{69}Al_{10}Cu_{20}Mo_1$ | 2 | >85% |
| 26. | $Ce_{68}Al_{10}Cu_{20}Mo_2$ | 4 | >60% |
| 27. | $Ce_{69}Al_{10}Cu_{20}Sc_1$ | 5 | >90% |
| 28. | $Ce_{69}Al_{10}Cu_{20}Ta_1$ | 2 | >90% |
| 29. | $Ce_{69}Al_{10}Cu_{20}Ti_1$ | 3 | >70% |
| 30. | $Ce_{69}Al_{10}Cu_{20}W_1$ | 2 | >70% |
| 31. | $Ce_{69}Al_{10}Cu_{20}Y_1$ | 1 | >70% |
| 32. | $Ce_{69}Al_{10}Cu_{20}Zr_1$ | 1 | >60% |
| 33. | $Ce_{69}Al_{10}Cu_{20}Bi_1$ | 2 | >60% |
| 34. | $Ce_{69}Al_{10}Cu_{20}Sn_1$ | 3 | >50% |
| 35. | $Ce_{68}Al_{10}Cu_{20}Sn_2$ | 4 | >50% |

What is claimed is:

1. An amorphous metallic plastic based on Cerium having a composition represented by the following formula (in atomic %):

$$Ce_dAl_eCu_fZ_g$$

TABLE I□

Critical diameter($d_c$), thermal parameters and elastic constants of Ce based amorphous metallic plastics

| Example No. | Composition | $d_c$ (mm) | $T_g$ (K) | $T_x$ (K) | ΔT (K) | $T_m$ (K) | $T_l$ (K) | E (GPa) | G (GPa) | K (GPa) |
|---|---|---|---|---|---|---|---|---|---|---|
| 1. | $Ce_{70}Al_{10}Cu_{20}$ | 2 | 341 | 410 | 69 | 647 | 722 | 29.91 | 11.25 | 29.18 |
| 2. | $Ce_{69.5}Al_{10}Cu_{20}Co_{0.5}$ | 10 | 341 | 419 | 78 | 639 | 716 | 31.08 | 11.64 | 31.25 |
| 3. | $Ce_{68}Al_{10}Cu_{20}Nb_2$ | 8 | 345 | 421 | 76 | 646 | 721 | 30.95 | 11.65 | 30.06 |
| 4. | $Ce_{65}Al_{15}Cu_{20}$ | 2 | 363 | 425 | 62 | 677 | 773 | | | |
| 5. | $Ce_{70}Al_{15}Cu_{15}$ | 2 | 364 | 406 | 42 | 660 | 775 | | | |
| 6. | $Ce_{60}Al_{20}Co_{20}$ | 5 | 424 | 468 | 44 | 684 | 798 | | | |
| 7. | $Ce_{70}Al_{10}Ni_{20}$ | 1 | 373 | 399 | 26 | 687 | 775 | | | |
| 8. | $Ce_{70}Al_{15}Ni_{15}$ | 1 | 368 | 387 | 19 | 691 | 738 | | | |
| 9. | $Ce_{69.8}Al_{10}Cu_{20}Co_{0.2}$ | 8 | 339 | 414 | 75 | 643 | 721 | 30.82 | 11.54 | 31.22 |
| 10. | $Ce_{69}Al_{10}Cu_{20}Co_1$ | 10 | 340 | 421 | 81 | 634 | 713 | 31.13 | 11.68 | 31.07 |
| 11. | $Ce_{68}Al_{10}Cu_{20}Co_2$ | 10 | 352 | 419 | 67 | 615 | 716 | 31.34 | 11.80 | 30.33 |
| 12. | $Ce_{65}Al_{10}Cu_{20}Co_5$ | 8 | 363 | 414 | 51 | 615 | 695 | | | |
| 13. | $Ce_{68}Al_{10}Cu_{20}Fe_2$ | 5 | 352 | 423 | 71 | 646 | 708 | 32.70 | 12.32 | 31.35 |
| 14. | $Ce_{68}Al_{10}Cu_{20}Ni_2$ | 5 | 352 | 421 | 69 | 647 | 710 | 31.93 | 11.98 | 31.77 |
| 15. | $Ce_{69}Al_{10}Cu_{20}Nb_1$ | 10 | 352 | 412 | 60 | 646 | 728 | | | |
| 16. | $Ce_{67}Al_{10}Cu_{20}Nb_3$ | 5 | 355 | 404 | 49 | 646 | 723 | | | |
| 17. | $Ce_{70}Al_{10}Cu_{19}Zn_1$ | 1 | 343 | 391 | 58 | 635 | 743 | | | |
| 18. | $Ce_{70}Al_{10}Cu_{18}Zn_2$ | 2 | 345 | 399 | 54 | 633 | 730 | | | |
| 19. | $Ce_{70}Al_{10}Cu_{17}Zn_3$ | 3 | 341 | 412 | 71 | 634 | 733 | | | |

Note:

1) $d_c$ is the smallest critical diameter for the fully glassy rod prepared under our own experimental conditions 2) Thermal parameters were measured by DSC at a constant heating rate of 10 K/min.

wherein $55 \leqq d \leqq 75$, $5 \leqq e \leqq 15$, $15 \leqq f \leqq 25$, $0.01 \leqq g \leqq 10$, $d+e+f+g=100$; and Z is selected from Hf, Mg, Mo, Nb, Sc, Ta, Ti, W, Zn and Zr wherein a glass transition temperature $T_g$ of the amorphous metallic plastic based on Cerium is 341-355 K.

2. The amorphous metallic plastic in claim 1, wherein said Ce, Al, Cu and Z have a purity of no less than 99.5 wt. %.

3. The amorphous metallic plastic in claim 1, wherein the amorphous metallic plastic is one of: $Ce_{70}Al_{10}Cu_{19}Zn_1$; $Ce_{70}Al_{10}Cu_{18}Zn_2$; $Ce_{70}Al_{10}Cu_{17}Zn_3$; $Ce_{69}Al_{10}Cu_{20}Nb_1$; $Ce_{68}Al_{10}Cu_{20}Nb_2$ and $Ce_{67}Al_{10}Cu_{20}Nb_3$.

* * * * *